US005183451A

United States Patent [19]

Hautamaki

[11] Patent Number: 5,183,451

[45] Date of Patent: Feb. 2, 1993

[54] MARTIAL ARTS PRACTICE DEVICE

[76] Inventor: Jeffrey L. Hautamaki, R.R. Box 162-A, Markesan, Wis. 53946

[21] Appl. No.: 772,577

[22] Filed: Oct. 7, 1991

[51] Int. Cl.[5] ..... A63B 64/20

[52] U.S. Cl. ..... 482/86; 482/127; 482/129; 482/83

[58] Field of Search ..... 482/129, 90, 84, 34, 482/83, 85-89; 273/55 R, 55 A, 55 D; 272/77

[56] References Cited

U.S. PATENT DOCUMENTS

| | | | |
|---|---|---|---|
| 3,427,021 | 4/1966 | Donoto | 273/55 R |
| 3,782,724 | 1/1974 | Rottman | 273/55 D |
| 3,958,801 | 5/1976 | Correa | 273/55 D |
| 4,565,366 | 1/1986 | Struss | 482/84 |
| 5,046,724 | 9/1991 | Sotomayer | 482/90 |

OTHER PUBLICATIONS

Black Belt Magazine, Jul. 1987 p. 87.

*Primary Examiner*—Richard J. Apley
*Assistant Examiner*—Jerome Donnelly

[57] ABSTRACT

A martial arts practice device essentially comprises an I-beam having a plurality of striking pads selectively positionable along its vertical height. The pads are cylindrically shaped and are attached to the I-beam by resilient springs so that they can flexibly move when struck by a user. A plurality of the devices may be interconnected so as to encircle a user to thus give the user the opportunity to strike in many different directions while improving his martial arts skills. Velcro attached padding may be positioned around the I-beam to prevent user injury, and various types of abrasive surface covers may be positioned over the pads to toughen a user's hands and feet.

1 Claim, 4 Drawing Sheets

MARTIAL ARTS PRACTICE DEVICE

BACKGROUND OF THE INVENTION

1. Field of the Invention

The present invention relates to exercising devices, and more particularly pertains to martial arts practice apparatuses.

2. Description of the Prior Art

The use of various types of padded striking devices which could be utilized to improve martial arts skills are well known in the prior art. Typical examples of such prior art striking apparatuses are to be found in U.S. Pat. No. 3,785,643, which is entitled "Erratic Movement Tethered Ball Striking Toy" and which issued to E. Rich on Jan. 15, 1974; U.S. Pat. No. 4,817,941 which is entitled "Adjustable Target Holder For Martial Arts Training" and which issued on Apr. 4, 1989 to T. McCorry; and U.S. Pat. No. 4,749,184 which is entitled "Self-restoring Kicking Practice Apparatus" and which issued to E. Tobin on Jun. 7, 1988.

Additionally, the use of resiliently movable striking pads wherein such pads are attached to a supporting structure by springs or the like are found in U.S. Pat. No. 4,702,472 which is entitled "Training Dummy For Combat Sports" and which issued on Oct. 27, 1987 to J. Anquetil; and also in U.S. Pat. No. 4,903,966 which is entitled "Device For Batting And Striking Practice" and which issued to L. Liao on Feb. 27, 1990.

All of these devices are functional for their intended purposes and the mere fact that so many patents have issued on such devices is indicative of consumer interest and demand. Inasmuch as a crowded art exists with such devices, new improvements are constantly being added to the store of public knowledge. Any improvement which could result in a more simpler construction that could be economically developed and sold would represent a major advance in the technology and in this respect, the present invention substantially fulfills this need.

SUMMARY OF THE INVENTION

In view of the foregoing disadvantages inherent in the known types of practice striking devices now present in the prior art, the present invention provides an improved practice striking device construction wherein the same can be economically manufactured and easily assembled and utilized. As such, the general purpose of the present invention, which will be described subsequently in greater detail, is to provide a new and improved practice striking device which has all the advantages of the prior art practice striking devices and none of the disadvantages.

To attain this, the present invention essentially comprising a martial arts practice device consisting of an I-beam having a plurality of striking pads selectively positionable along its vertical height. The pads are cylindrically shaped and are attached to the I-beam by resilient springs so that they can flexibly move when struck by a user. A plurality of the devices may be interconnected so as to encircle a user to thus give the user the opportunity to strike in many different directions while improving his martial arts skills. Velcro attached padding may be positioned around the I-beam to prevent user injury, and various types of abrasive surface covers may be positioned over the pads to toughen a user's hands and feet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved practice striking device which has all the advantages of the prior art practice striking devices and none of the disadvantages.

It is another object of the present invention to provide a new and improved practice striking device which may be easily and efficiently manufactured and marketed.

It is a further object of the present invention to provide a new and improved practice striking device which is of a durable and reliable construction.

An even further object of the present invention is to provide a new and improved practice striking device which is susceptible of a low cost of manufacture with regard to both materials and labor, and which accordingly is then susceptible of low prices of sale to the consuming public, thereby making such practice striking devices economically available to the buying public.

Still yet another object of the present invention is to provide a new and improved practice striking device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
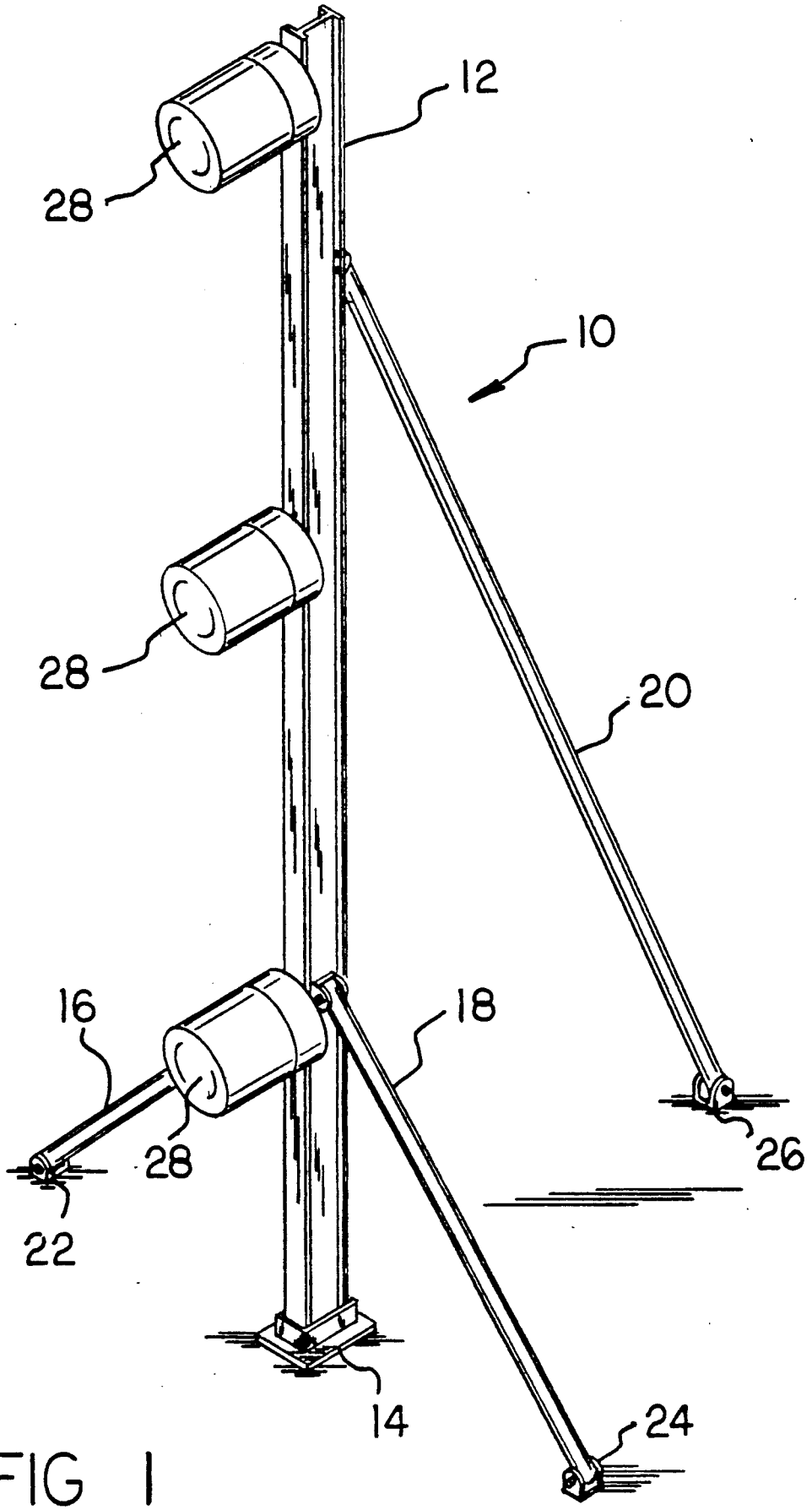
FIG. 1 is a perspective view of the practice striking device comprising the present invention.
Figure 2:
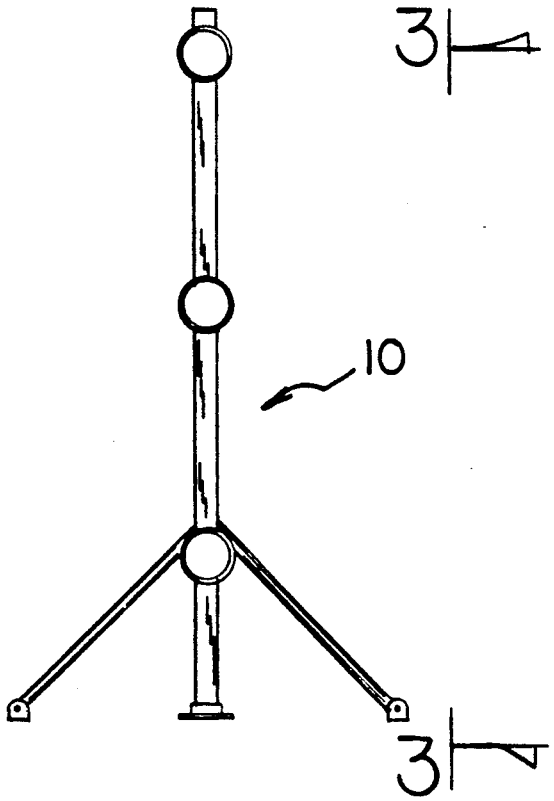
FIG. 2 is a front elevation view of the invention.
Figure 3:
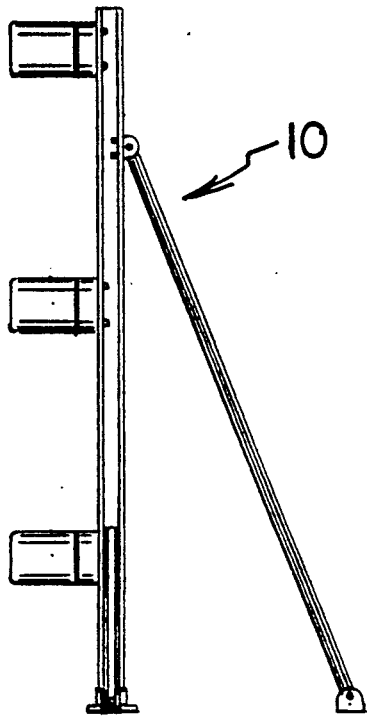
FIG. 3 is a side elevation view of the invention as viewed along the line 3—3 in FIG. 2.

With reference now to the drawings, and in particular to FIGS. 1–3 thereof, a new and improved practice striking device embodying the principles and concepts of the present invention and generally designated by the reference numeral 10 will be described.

More specifically, it will be noted that the practice striking device 10 essentially consists of an upstanding I-beam 12 supported by a mounting plate 14 and a plurality of adjustable side braces 16, 18, 20. Each of the side braces 16, 18, 20 are provided with pivotally adjustable shoes 22, 24, 26 respectively and once these shoes are positioned as desired, threaded fasteners associated therewith may be tightened to lock them in position. Additionally, each of the side supports 16, 18, 20 are pivotally attached to the I-beam 12 and may be locked in position by threaded fasteners once they are positioned where desired.

With continuing reference to FIGS. 1–3, there is shown a plurality of striking pads attached to the I-beam with each of these striking pads being designated by the reference numeral 28. The striking pads 28 are removably attached to the I-beam 12 and are flexibly movable in response to a punch or kick being delivered by a user.

Figure 4:
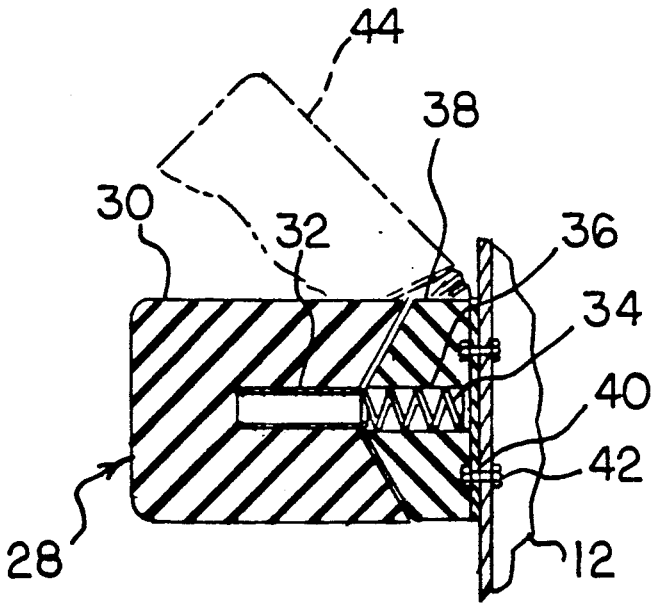
FIG. 4 is a cross-sectional view of a striking pad associated with the invention.

FIG. 4 of the drawings illustrates the structure of each striking pad 28. In this connection, a typical striking pad 28 would include a cylindrically shaped flexible pad member 30 fixedly secured over a pintle with the pintle being attached to a flexibly movable spring 34. The spring 34 is retained within an aperture 36 formed in a truncated conically-shaped base plate 38, and the base plate 38 is fixedly secured to a connection plate 40 which may be directly attached to an I-beam 12 by threaded fasteners 42.

In use, when a user strikes the flexible cushion 30, it will be deflected to a new position 44 due to the fact that it can slidably move over the base plate 38 and further because it is attached to the plate 38 only by the spring 34. After a strike, the spring 34 causes the pad 30 to recede over the conical surface of the base plate 38 in a now apparent manner.

Figure 5:
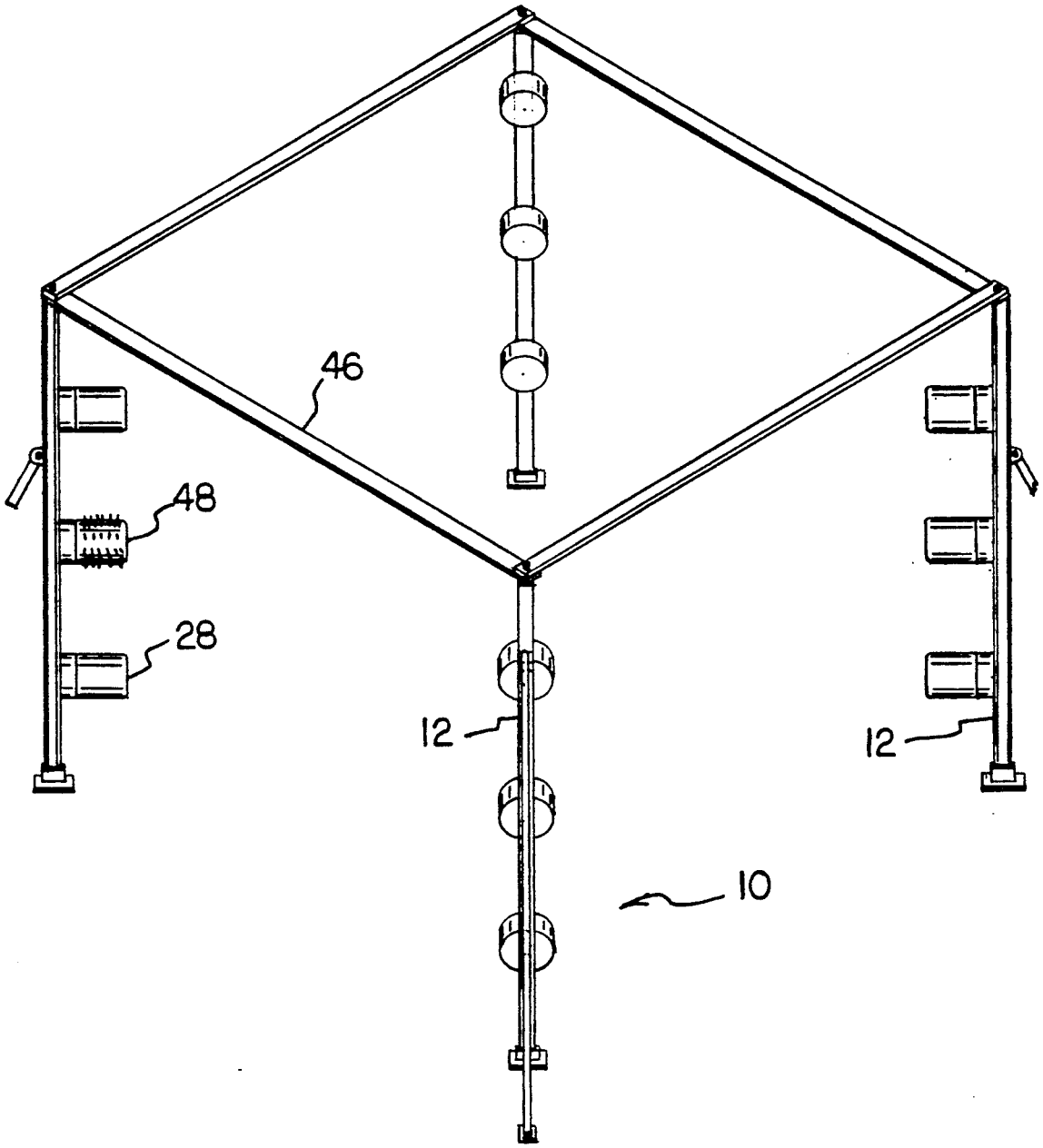
FIG. 5 is a perspective view of a modified embodiment of the invention.

FIG. 5 of the drawings illustrates the versatility of the present invention wherein the plurality of practice striking devices 10 are positioned in a square shape and are supported by a plurality of top beams 46 which are threadably attachable to the top of each I-beam 12. This arrangement permits the user to stand in the center of the square area defined by the four practice devices 10, and martial arts skills can then be improved by striking out in all directions at the plurality of striking pads 28. Additionally, a variation of the invention is illustrated by an abrasive cover 48 which is removably positioned over one of the cylindrical pads 30. This abrasive cover serves to toughen the skin of an individual who strikes it, thus to form callouses which is desirable to a martial arts practitioner.

Figure 6:
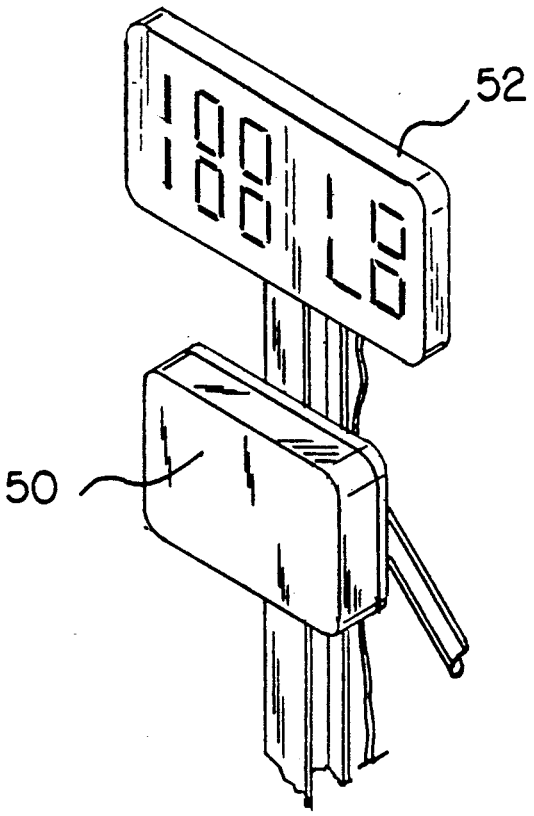
FIG. 6 is a perspective view of a force meter associated with the invention.

FIG. 6 of the drawings illustrates a modified pad 50 which may be provided with conventional pressure sensors and a digital display 52, thereby to allow an indication of the amount of force experienced by the pad 50 once it is struck by a user.

Figure 7:
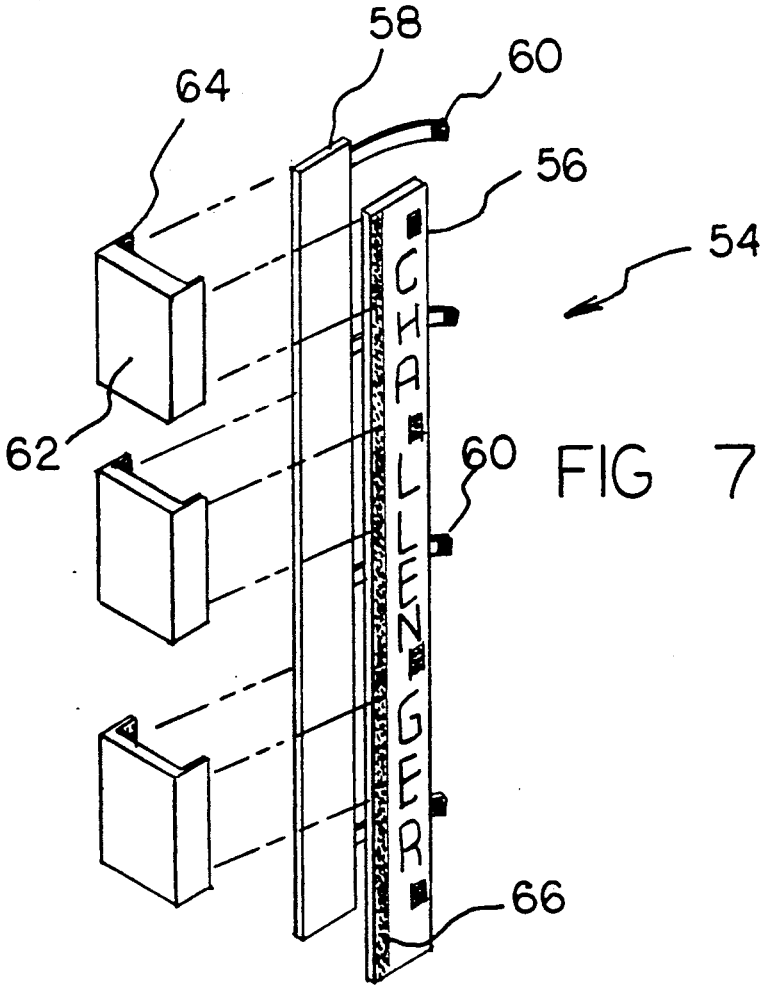
FIG. 7 is an exploded perspective view of the removable pad structure associated with the invention.

FIG. 7 illustrates a pad assembly 54 which can be utilized to cover each I-beam 12. The pad assembly 54 includes two longitudinal pads 56, 58 which wrap around the I-beam 12 and which are interconnected by a plurality of velcro straps 60. Additionally, a plurality of smaller pads 62 may have velcro side straps 64 which are engageable with elongated velcro strips 66 on the main pads 56, 58, and these smaller pads are positionable above and below the striking pads 28 so as to provide a safe striking surface for a user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved practice striking device comprising:

upstanding support means, said upstanding support means including at least one I-beam;

base plate means for holding said upstanding support means;

striking pad means resiliently attached to said upstanding support means, spring means to effect a resilient attachment of said striking pad means to said upstanding support means, said spring means being connected between said striking pad means and said upstanding support means, said spring means being an exclusive and only means of attachment of said striking pad means to said upstanding support means, a truncated conically-shaped plate, said striking pad means, further comprising a concave surface to be positioned over said truncated conically-shaped plate, said truncated conically-shaped plate, in co-operation with said striking pad means, is configured to aide in facilitating a return of said striking pad means to a correct position once said striking pad means has been resiliently moved due to a user striking said striking pad means;

an abrasive cover positioned over said striking pad means, said abrasive cover serving to frictionally engage a user's appendages so as to roughen and thicken a skin surface of said force indicating means for indicating to a user how hard of a strike was delivered by said user against said striking pad means;

removable pad means positioned over said upstanding support means, said removable pad means protecting a user against injury in the event of said user inadvertently striking said upstanding support means; and said support means for providing greater support to said upstanding support means.

* * * * *